US008960160B2

(12) United States Patent
Mizuguchi et al.

(10) Patent No.: US 8,960,160 B2
(45) Date of Patent: Feb. 24, 2015

(54) ENGINE WORKING MACHINE

(75) Inventors: Hiroshi Mizuguchi, Wako (JP); Hiroko Murakami, Wako (JP); Hayato Matsuda, Wako (JP); Takeshi Fukawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 431 days.

(21) Appl. No.: 13/454,361

(22) Filed: Apr. 24, 2012

(65) Prior Publication Data

US 2012/0277978 A1 Nov. 1, 2012

(30) Foreign Application Priority Data

Apr. 26, 2011 (JP) ..... 2011-098162

(51) Int. Cl.
*F02M 37/04* (2006.01)
*F02B 63/04* (2006.01)
*F02M 37/00* (2006.01)

(52) U.S. Cl.
CPC ..... *F02B 63/04* (2013.01); *F02M 37/007* (2013.01); *F02M 37/0029* (2013.01)
USPC ..... 123/509; 123/495

(58) Field of Classification Search
CPC ..... F02M 37/00; F02M 37/0011; F02M 37/0047; F02M 37/007; F02M 37/0076; F02M 37/08; F02M 37/04; F02M 37/10; F02M 37/103; F02M 37/106
USPC ..... 701/103; 123/3, 445, 468, 495, 497, 123/509, 198 C
See application file for complete search history.

(56) References Cited

U.S. PATENT DOCUMENTS

| | | | | |
|---|---|---|---|---|
| 4,653,762 | A * | 3/1987 | Nakamura et al. | 280/835 |
| 6,357,424 | B1 * | 3/2002 | Sonoda et al. | 123/509 |
| 6,932,177 | B2 * | 8/2005 | Hara et al. | 180/219 |
| 7,571,714 | B2 * | 8/2009 | Miyashiro | 123/470 |
| 7,757,670 | B2 * | 7/2010 | Yamada et al. | 123/509 |

(Continued)

FOREIGN PATENT DOCUMENTS

| | | |
|---|---|---|
| CN | 1412429 | 4/2003 |
| CN | 1198074 | 4/2005 |

(Continued)

OTHER PUBLICATIONS

Chinese Office Action with English Translation, dated Jan. 28, 2014, 21 pages.

(Continued)

*Primary Examiner* — Erick Solis
*Assistant Examiner* — Anthony L Bacon
(74) *Attorney, Agent, or Firm* — Rankin, Hill & Clark LLP

(57) ABSTRACT

An engine working machine that has an electronically controlled fuel injection system and a fuel tank disposed in an upper portion. The capacity of the fuel tank is effectively used and a complex structure is prevented while reducing the length of the fuel piping. An engine is disposed in a lower portion, and a fuel tank is disposed above the engine. A fuel pump is mounted on a bottom outside surface of the fuel tank, and disposed projecting on a side portion of the crankcase. An extended box is provided on a bottom surface of the fuel tank, and the fuel pump is mounted with a filter and a fuel intake port located inside the extended box. The fuel pump is housed in a pump case that is fixed to a bottom surface of the extended box.

13 Claims, 4 Drawing Sheets

(56) References Cited

U.S. PATENT DOCUMENTS

| | | | | |
|---|---|---|---|---|
| 8,038,172 | B2 * | 10/2011 | Morikawa | 280/833 |
| 2001/0047827 | A1 * | 12/2001 | Murakoshi et al. | 137/565.34 |
| 2004/0065305 | A1 * | 4/2004 | Ehara et al. | 123/509 |
| 2005/0150706 | A1 | 7/2005 | Eguchi et al. | |
| 2005/0201877 | A1 | 9/2005 | Mitsudou | |
| 2005/0279330 | A1 * | 12/2005 | Okazaki et al. | 123/509 |
| 2009/0242300 | A1 * | 10/2009 | Mizukura et al. | 180/69.4 |
| 2011/0303196 | A1 * | 12/2011 | Kobayashi | 123/495 |

FOREIGN PATENT DOCUMENTS

| | | |
|---|---|---|
| CN | 1267638 | 8/2006 |
| JP | 10-196391 | 7/1998 |
| JP | 11-343860 | 12/1999 |

OTHER PUBLICATIONS

Chinese Office Action with English Translation dated Jul. 23, 2014, 7 pages.

* cited by examiner

ENGINE WORKING MACHINE

TECHNICAL FIELD

The present invention relates to an engine working machine which is driven by an engine as a power source, and particularly, to an engine working machine which is characterized by an arrangement of a pump that supplies an engine with fuel under pressure.

BACKGROUND ART

Engine working machine such as a generator or a water pump powered by engine, in which a fuel tank is mounted on a frame made of a pipe in a manner to cover an upper surface of the engine and working machine is known (Refer to Patent Document 1). Generator in which a fuel tank is disposed in an upper portion of a frame, and an engine cylinder is disposed oriented in an oblique direction within the frame is also known (Refer to Patent Document 2).

CITATION LIST

Patent Literature

Patent Literature 1 Japanese Unexamined Patent Application Publication No. 10-196391

Patent Literature 2 Japanese Unexamined Patent Application Publication No. 11-343860

SUMMARY OF INVENTION

Technical Problem

As described in Patent Documents 1 and 2, the fuel tank disposed in an upper portion of the frame serves as an upper cover that covers an upper portion of an engine and working machine body (e.g. generator, water pump), and can protect the engine working machine against water drops, dust, etc., that fall on the engine and working machine body from above. The fuel tank performs such a function and is thus desirably disposed in an upper portion of the engine working machine.

When using an electronically controlled fuel injection system for an engine, it is necessary to determine the position of a fuel pump that supplies fuel under pressure to a fuel injection valve. Typically, the fuel pump is mounted on an upper surface inside the fuel tank, in such positioning, however, the length of the fuel piping is lengthened, and there arises a problem of insulation from operating noise of the fuel pump, waterproofing of the piping, and protection from external force. On the other hand, when the fuel pump is disposed on a lower surface inside the fuel tank, there has been a problem such that fuel in the fuel tank cannot be used up unless a fuel intake port and a filter are transversely positioned and the fuel pump is disposed on a lowermost surface inside the fuel tank, and the fuel pump has a complex mounting structure in a case where the fuel intake port and filter are located downward.

It is an object of the present invention to provide, in response to the problems described above, an engine powered working machine which enables a fuel pump arrangement that allows effective use of the capacity of the fuel pump and prevents a complex structure.

Solution to Problem

A first feature of the present invention is that an engine working machine including an electronically controlled fuel injection system for which an engine and a working machine are disposed in a lower portion, and a fuel tank is disposed above the engine and the working machine, the engine working machine comprising a fuel pump mounted on a bottom surface of the fuel tank from outside.

A second feature of the present invention is that the engine is formed of a crankcase and a cylinder head that extends obliquely upward from the crankcase toward a bottom surface of the fuel tank, and the fuel pump is disposed to overhang a side portion of the crankcase located lower than the cylinder head.

A third feature of the present invention is the engine working machine comprising an extended portion formed on a bottom surface of the fuel tank, wherein the fuel pump is mounted on the extended portion with a filter and a fuel intake port located inside the extended portion.

A fourth feature of the present invention is that the fuel pump is housed in a pump case, and the pump case is fixed to a bottom surface of the fuel tank or the extended portion.

A fifth feature of the present invention is that the pump case has an external form of a cylinder body on which a flange is provided, an inner cylinder body is further provided at an inside of the cylinder body, the inner cylinder body holds the fuel pump, and the flange is bolted to a bottom surface of the fuel tank or the extended portion with sealing means interposed.

A sixth feature of the present invention is that the inner cylinder body is communicated at its upside with a fuel tank and is sealed by a cap at its downside, and a discharge port of the fuel pump held by the inner cylinder body projects into a buffer space formed between the inner cylinder body and the cap.

A seventh feature of the present invention is that a pressure regulator is mounted in the buffer space, and the pressure regulator is provided with a tube to return a back pressure to a gaseous phase.

An eighth feature of the present invention is that the working machine is a generator or a water pump that is driven by an engine.

Advantageous Effects of Invention

According to the present invention having the first to eighth features described above, the fuel pump can be disposed effectively using a space formed between a complex external outline of the engine, working machine, etc., and the bottom surface of the fuel tank having a simple external outline.

According to the present invention having the second feature, the fuel pump can be disposed in a larger space formed between the bottom surface of the fuel tank and the engine.

According to the present invention having the third feature, since the filter etc., of the fuel pump can be housed in the expansion chamber, the capacity of the fuel tank can fully be used.

According to the present invention having the fourth feature, since the fuel pump can be held by use of the pump case, the mounting structure to the fuel tank can be arbitrarily selected.

According to the present invention having the fifth feature, since the fuel pump is freely mountable and dismountable with respect to the fuel pump, maintenance work is easy.

According to the present invention having the sixth feature, since fuel discharged from the fuel pump can be supplied to the exterior via the buffer space, the supply pressure can be stabilized.

According to the present invention having the seventh feature, the discharge pressure can be further stabilized by returning the back pressure of the pressure regulator to a gaseous phase.

According to the present invention having the eighth feature, the fuel pump can be disposed effectively using a space formed between the working machine, such as an engine-driven generator or water pump, whose external form or outline is complex and highly irregular and the fuel tank generally having a flat bottom surface.

DESCRIPTION OF EMBODIMENTS

Figure 1:
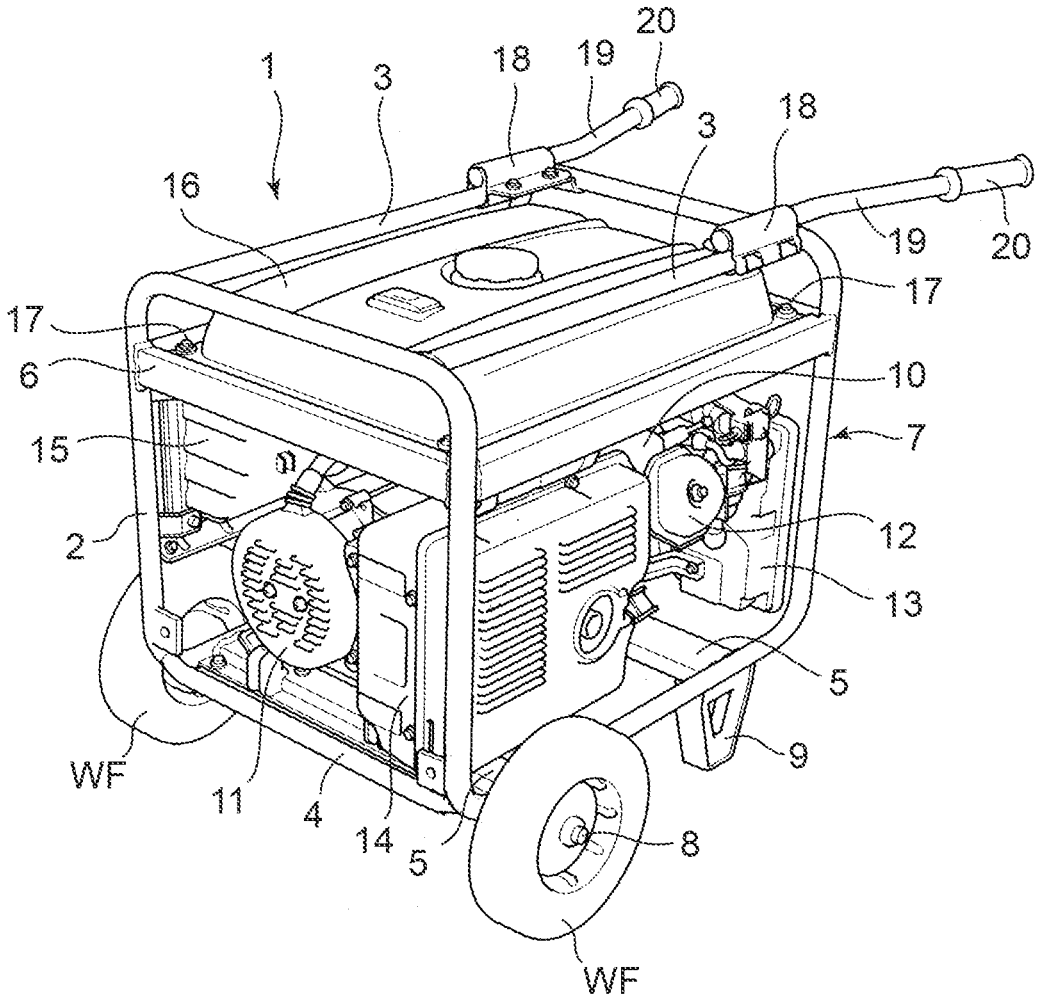
FIG. 1 is a perspective view of an engine generator according to an embodiment of the present invention.

Hereinafter, an embodiment of the present invention will be described with reference to the drawings. FIG. 1 is a perspective view of an engine generator which is an engine powered working machine according to an embodiment of the present invention. The engine generator 1 includes wheels WF so as to be movable. In the present specification, the side on which the wheels WF are provided is referred to as a "front" of the engine generator 1, and the direction in which the wheels WF have axles extended is referred to as a "width direction."

The engine generator 1 includes a generator frame 7 formed of a main frame 2 made of a pipe, a pair of upper sub-frames 3, 3 extending to the front and rear in an upper portion of the main frame 2, a front sub-frame 4 extending in the width direction in a lower portion of the main frame 2, a pair of bottom sub-frames 5, 5 extending in the width direction in the lower portion of the main frame 2, and a tank support frame 6 both ends of which are connected to four corners of the main frame 2 at locations closer to the upside of the main frame 2, respectively.

One of the bottom sub-frames 5, 5 that is closer to the front supports an axle 8 of the wheel WF, and the other of the bottom sub-frames 5, 5 that is closer to the rear supports a pair of stands 9 (only one of them is shown) disposed separated in the width direction.

The bottom sub-frames 5, 5 further carry an engine 10 and a generator 11 placed thereon. An air cleaner 13 is disposed in the rear of a cylinder head 12 of the engine 10, and a muffler 14 is disposed at one side of the generator 11 (left side when viewed from the rear of the engine generator 1). At the other side (right side when viewed from the rear of the engine generator 1) of the generator 11, an operation panel 15 (a back side of which is shown) including a control unit and a display unit is disposed.

The tank support frame 6 is provided with brackets (not shown) at four corners, and by fixing four sites of a top-bottom mating portion that overhangs circumferentially from the middle in an upper and lower direction of a fuel tank 16 to the brackets by use of bolt-and-nut 17 sets, the fuel tank 16 is carried on the generator frame 7.

The pair of upper sub-frames 3, 3 have handles 19, 19 that are attached by use of clamps 18, 18, respectively. End portions of the handles 19, 19 are covered with rubber grips 20, 20 that can be gripped by an operator.

The engine generator 1 having this configuration includes a known recoil starter (not shown) of the engine 10 that is adjacent to the right side of the air cleaner 13, and the engine 10 is rotated by pulling a rope of the recoil starter. The generator 11 rotates to generate power when the engine 10 is rotated by the recoil starter, a fuel pump (described later in detail) is driven by the control unit that is being started by the generated power, and fuel is supplied under pressure from the fuel tank 16 to a fuel injection valve (not shown) of the engine 10 responsive to an ignition signal of the engine 10 being output. The engine 10 is started when the fuel is fed together with air to a combustion chamber according to the fuel injection valve opening at a predetermined timing and the mixture is ignited by an ignition device (not shown). When the engine 10 starts, the generator 11 starts power generation, conventionally known control is performed to continue the power generating operation, and an output voltage of the generator 11 is connected to a predetermined output end (outlet or socket). The outlet may be provided on an operation panel 15.

Figure 2:
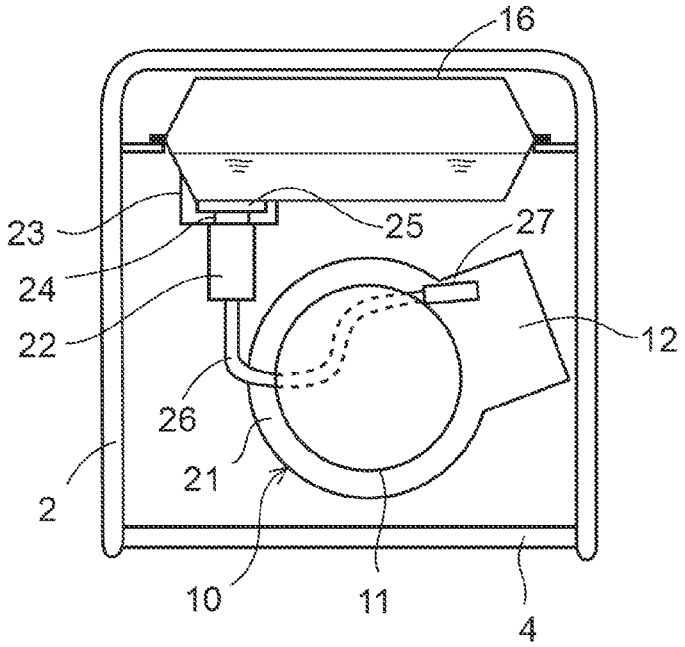
FIG. 2 is a front view of the engine generator.

Next, a fuel pump to be mounted on the fuel tank 16 will be described. FIG. 2 is a front view of the engine generator 1. In FIG. 2, the engine 10 is formed of a crankcase 21 and a cylinder head 12 that sticks out obliquely upward from the crankcase 21 toward a bottom surface of the fuel tank 16. The fuel tank 16 is located above the engine 10 and generator 11. Because the bottom surface of the fuel tank 16 is flat, it looks as if there were no large space between the engine 10 and generator 11 and the fuel tank 16, but a relatively large space exists between the fuel tank 16 having a flat bottom surface and the engine 10 and generator 11 whose external form or outline is irregular. Particularly, the cylinder head 12 sticks out obliquely upward and thus has a small gap with the fuel tank 16, but the outer peripheral shape of the crankcase 21 is an arc, the crankcase 21 is located lower than the cylinder head 12, and there is thus a relatively large space produced between the crankcase 21 and the fuel tank 16. Therefore, a fuel pump 22 is disposed in the space produced between the crankcase 21 and the fuel tank 16.

To the bottom surface of the fuel tank 16, an extended portion (expansion box) 23 of the fuel tank 16 is joined, and the fuel pump 22 whose external form is generally cylindrical is mounted from below on the extended box 23. The fuel pump 22 has a fuel intake port 24 facing the interior of the expansion box 23, and a filter 25 attached to the fuel intake port 24 is housed inside the expansion box 23. Since the fuel intake port 24 and the filter 25 are located inside the expansion box 23 extended downward from the fuel tank 16, the capacity of the fuel tank 16 can be effectively used. The fuel pump 22 is connected at a discharge port with a fuel pipe 26, and an end portion of the fuel pipe 26 is connected to a fuel injection valve (injector) 27 provided in the engine 10.

Figure 3:
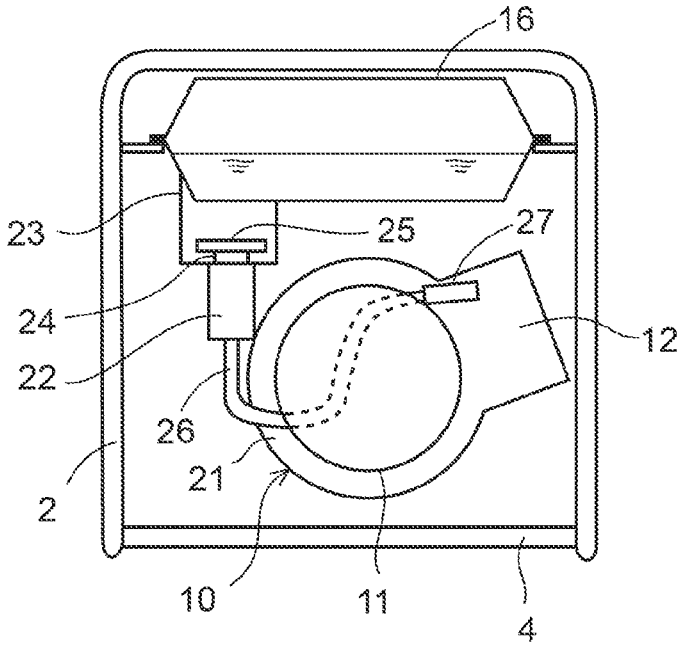
FIG. 3 is a front view of an engine generator according to a second embodiment.

FIG. 3 is a view showing a modification (second embodiment) of a mounting mode of a fuel pump, and the same reference signs as those in FIG. 2 denote the same or equivalent parts. In the example of FIG. 3, the expansion box 23 is extended further downward to expand the capacity of the expansion box 23. The capacity of the fuel tank 16 is substantially expanded by using the space produced between the crankcase 21 and the fuel tank 16 as large as possible. Unlike the case of supplying fuel by a carburetor system, since the fuel pump 22 can be at any height position in the engine 10 including a fuel injection system, the expansion box 23 can be extended downward so far as the space permits to secure a larger fuel retention capacity.

Figure 4:
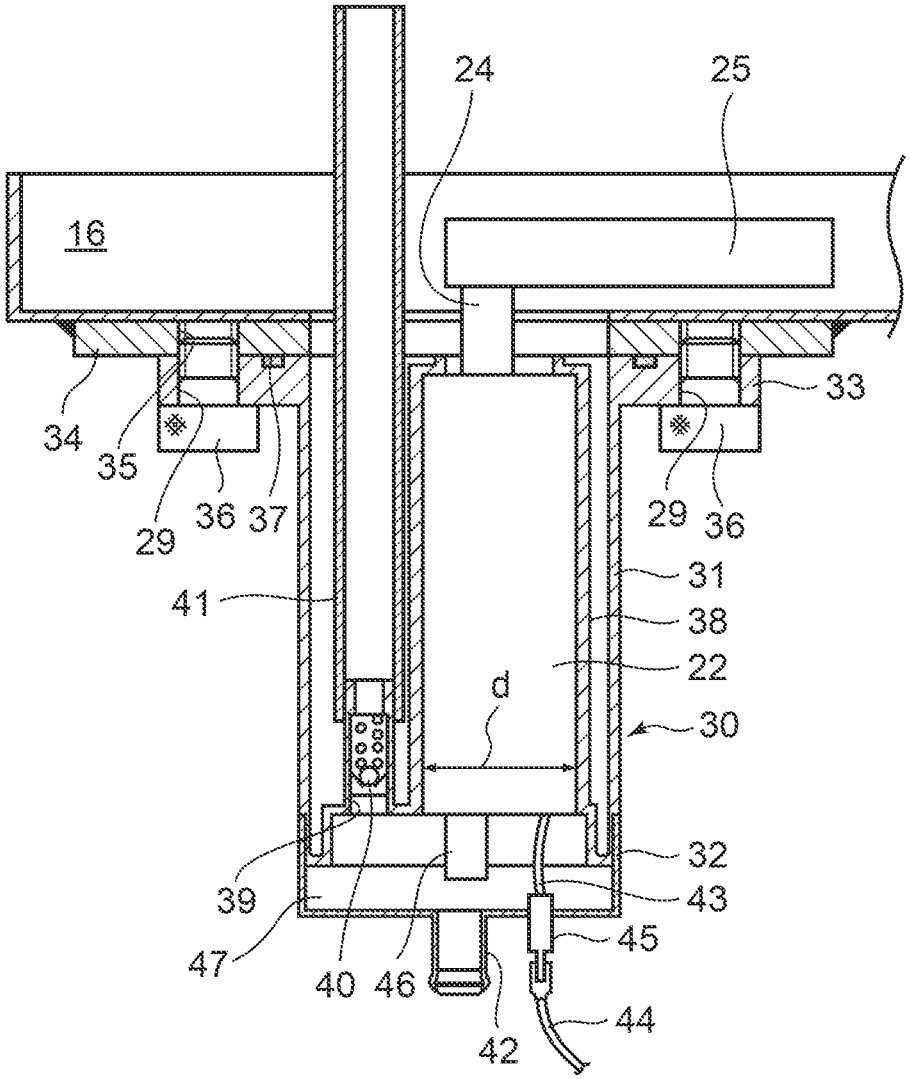
FIG. 4 is a sectional view of a fuel pump of an engine generator according to a third embodiment.
Figure 5:
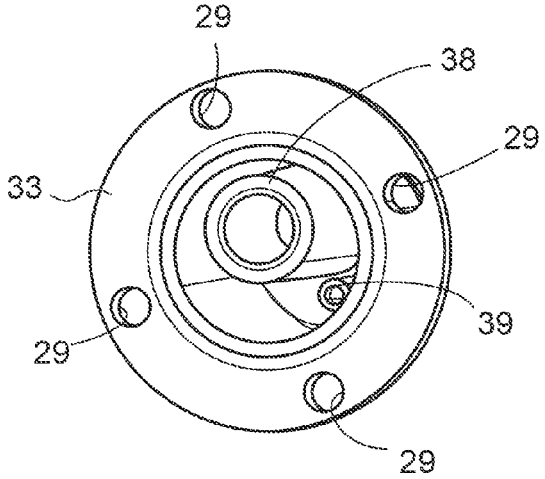
FIG. 5 is a perspective view showing an interior of a pump case.
Figure 6:
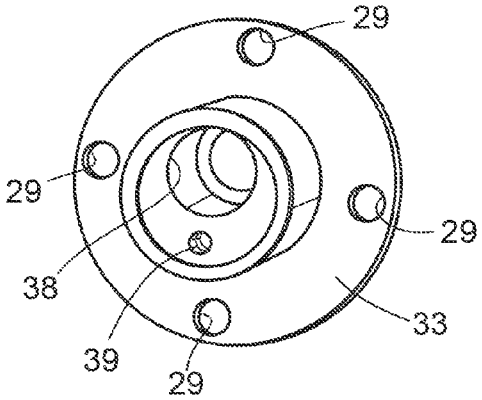
FIG. 6 is a perspective view showing an external appearance of an upper portion of the pump case.
Figure 7:
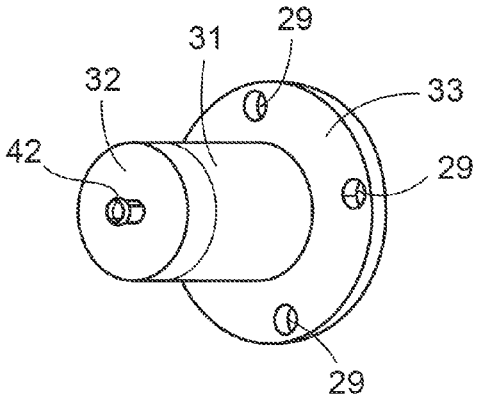
FIG. 7 is a perspective view showing an external appearance of a lower portion of the pump case.

FIG. 4 is a sectional view of a fuel pump according to a third embodiment of the present invention. FIG. 5 is a perspective view showing an interior of a pump case, FIG. 6 is a perspective view of a case body of the pump case viewed from above, FIG. 7 is a perspective view of the case body 31 viewed from below, and the same reference signs as those in FIG. 4 denote the same or equivalent parts.

In FIG. 4 to FIG. 7, the fuel pump 22 is housed in a pump case 30 and mounted on the fuel tank 16. The pump case 30 consists of a case body 31 and a cap 32 that covers a bottom portion of the case body 31, and a flange 33 for mounting is provided at an upper portion of the case body 31. On the other hand, a mounting seat (annular plate) 34 that receives the flange 33 of the case body 31 is joined by a method such as welding to the bottom surface of the fuel tank 16.

The mounting seat 34 includes female screws 35 at a plurality of sites (for example, four sites), and bolts 36 inserted through bolt through-holes 29 provided in the flange 33 of the case body 31 so as to be aligned with the female screws 35 are screwed in the female screws 35, respectively. The flange 33 includes a seal groove formed on a surface opposed to the mounting seat 34, and seal between the flange 33 and the mounting seat 34 is secured by an O-ring 37 that fits in the seal groove.

The case body 31 is a cylinder body, and further includes in its interior an inner cylinder body 38 that holds the fuel pump 22. The inner cylinder body 38 is provided eccentrically with respect to an axis of the cylindrical case body 31, and has an inner diameter "d" that is adapted to the external size of the fuel pump 22. The inner cylinder body 38 is open at the top and bottom, and the fuel intake port 24 passes through the open part of the upper portion and the filter 25 is attached to the end of the fuel intake port 24, that is, the side of the fuel tank 16.

The surroundings of the inner cylinder body 38 are open at an upper portion to communicate with the fuel tank 16, and a lower portion thereof excluding a regulator housing portion 39 is closed. The regulator housing portion 39 is a cylinder body extending parallel to the inner cylinder body 38, and houses a pressure regulator 40. The pressure regulator 40 can have a well-known structure formed of a valve and a spring. The regulator housing portion 39 is covered with a pressure stabilizing tube 41. The pressure stabilizing tube 41 is extended to the inside of the fuel tank 16, and performs a function of returning the back pressure of the pressure regulator 40 to a gaseous phase. Returning the back pressure of the pressure regulator 40 to a gaseous phase allows stabilization of the discharge pressure of the fuel pump 22. It is preferable to provide the pressure stabilizing tube 41 in the sense of better stabilization of the discharge pressure, but the pressure stabilizing tube 41 is not essential.

The cap 32 includes a connector portion 42 to which the fuel pipe 26 is joined. The cap 32 also includes an electrode 45 for connecting a lead wire 43 that supplies a drive motor (not shown) of the fuel pump 22 with electricity to an external harness 44. It is preferable to mold the electrode 45 integrally with the cap 32.

In the third embodiment, an example of the pump case 30 mounted on the bottom surface 16 has been shown, but this structure may be applied to the first and second embodiments so as to mount the pump case 30 housing the fuel pump 22 on a bottom surface of the expansion box 23.

During operation of the fuel pump 22, the fuel inside the fuel tank 16 passes through the filter 25 located at a lowermost portion of the fuel tank 16, and is introduced into the fuel pump 22 from the fuel intake port 24. Then, the fuel discharged from the discharge port 46 is retained in a space (buffer) 47 between the case body 31 and the cap 32. The pressure of the fuel retained in the buffer 47 is regulated to a constant pressure by the pressure regulator 40. Further, the fuel is discharged from the connector portion 42 of the cap 32, and fed to the injector 27 through the fuel pipe 26 described above.

Although the present invention has been described in accordance with the embodiments, the present invention is not limited to these embodiments, and modifications can be made based on the matters described in the claims and the known art. For example, it suffices that the fuel pump 22 is disposed in a manner projecting in the space between the fuel tank 16 and the engine 10 and generator 11, without limitation to providing at a position close to a bottom portion of the crankcase 21. Moreover, the engine working machine is not limited to a generator that is driven by an engine, and may be a water pump that is driven by an engine.

REFERENCE SIGNS LIST

1 . . . engine generator
2 . . . main frame
7 . . . generator frame
12 . . . cylinder head
16 . . . fuel tank
21 . . . crankcase
22 . . . fuel pump
23 . . . extended box
24 . . . fuel intake port
25 . . . filter
26 . . . fuel pipe
27 . . . fuel injection valve (injector)
30 . . . pump case
31 . . . case body
32 . . . cap
34 . . . mounting seat (annular plate)
38 . . . inner cylinder body
40 . . . pressure regulator
45 . . . electrode
46 . . . discharge port
47 . . . buffer

The invention claimed is:

1. An engine working machine including an electronically controlled fuel injection system for which an engine and a working machine are disposed in a lower portion, and a fuel tank is disposed above the engine and the working machine, the engine working machine comprising a fuel pump mounted on a bottom surface of the fuel tank from outside, wherein the pump case has an external form of a cylinder body on which a flange is provided, an inner cylinder body is further provided at an inside of the cylinder body, the inner cylinder body holds the fuel pump, the flange is bolted to a bottom surface of the fuel tank or the extended portion with sealing means interposed, the inner cylinder body is communicated at its upside with a fuel tank and is sealed by a cap at its downside, and a discharge port of the fuel pump held by the inner cylinder body projects into a buffer space formed between the inner cylinder body and the cap.

2. The engine working machine according to claim 1, wherein the engine is formed of a crankcase and a cylinder head that extends obliquely upward from the crankcase toward a bottom surface of the fuel tank, and the fuel pump is disposed to overhang a side portion of the crankcase located lower than the cylinder head.

3. The engine working machine according to claim 1, comprising an extended portion formed on a bottom surface of the fuel tank, wherein the fuel pump is mounted on the extended portion with a filter and a fuel intake port located inside the extended portion.

4. The engine working machine according to claim 1, wherein the fuel pump is housed in a pump case, and the pump case is fixed to a bottom surface of the fuel tank or the extended portion.

5. The engine working machine according to claim 1, wherein a pressure regulator is mounted in the buffer space, and the pressure regulator is provided with a tube to return a back pressure to a gaseous phase.

6. The engine working machine according to claim 1, wherein the working machine is a generator that is driven by an engine.

7. The engine working machine according to claim 2, wherein the working machine is a generator that is driven by an engine.

8. The engine working machine according to claim 3, wherein the working machine is a generator that is driven by an engine.

9. The engine working machine according to claim 4, wherein the working machine is a generator that is driven by an engine.

10. The engine working machine according to claim 1, wherein the working machine is a water pump that is driven by an engine.

11. The engine working machine according to claim 2, wherein the working machine is a water pump that is driven by an engine.

12. The engine working machine according to claim 3, wherein the working machine is a water pump that is driven by an engine.

13. The engine working machine according to claim 4, wherein the working machine is a water pump that is driven by an engine.

* * * * *